US008205964B2

(12) United States Patent
Saito

(10) Patent No.: US 8,205,964 B2
(45) Date of Patent: Jun. 26, 2012

(54) HEAD ARRAY UNIT, IMAGE FORMING APPARATUS INCLUDING SAME, AND METHOD FOR MANUFACTURING THE HEAD ARRAY UNIT

(75) Inventor: Akira Saito, Kakuda (JP)

(73) Assignee: Ricoh Company, Ltd., Tokyo (JP)

( * ) Notice: Subject to any disclaimer, the term of this patent is extended or adjusted under 35 U.S.C. 154(b) by 647 days.

(21) Appl. No.: 12/319,513

(22) Filed: Jan. 8, 2009

(65) Prior Publication Data

US 2009/0174750 A1 Jul. 9, 2009

(30) Foreign Application Priority Data

Jan. 8, 2008 (JP) ..... 2008-001688
Dec. 9, 2008 (JP) ..... 2008-313722

(51) Int. Cl.
*B41J 2/14* (2006.01)
*B41J 2/15* (2006.01)
*B41J 2/155* (2006.01)

(52) U.S. Cl. ..... 347/49; 347/40; 347/42

(58) Field of Classification Search ..... 347/40, 347/42, 43, 49, 71; 29/890.1
See application file for complete search history.

(56) References Cited

U.S. PATENT DOCUMENTS

| | | | | |
|---|---|---|---|---|
| 6,227,657 | B1 * | 5/2001 | Raisanen et al. | 347/58 |
| 7,234,798 | B2 * | 6/2007 | Sanpei et al. | 347/85 |
| 2005/0040581 | A1 * | 2/2005 | Ito | 270/58.13 |

FOREIGN PATENT DOCUMENTS

| | | |
|---|---|---|
| JP | 3552522 | 5/2004 |
| JP | 3831936 | 7/2006 |
| JP | 2007-136254 | 6/2007 |
| WO | WO 2004/022344 | 3/2004 |

* cited by examiner

*Primary Examiner* — Geoffrey Mruk
(74) *Attorney, Agent, or Firm* — Cooper & Dunham LLP

(57) ABSTRACT

The present invention provides a head array unit in which a plurality of head members is easily aligned on an alignment member with a simple structure and a method for manufacturing the head array unit, and an image forming apparatus including the head array unit. The head array unit includes a head unit. The head unit includes a head member, a head member retainer, and an alignment member. The head member includes a plurality of nozzles and is configured to eject liquid droplets. The head member retainer, on which the head member is disposed and fixed thereto, includes a reference hole for aligning the head unit relative to the alignment member. The alignment member includes an opening formed at a location associated with the reference hole and relatively larger than the reference hole. The head member may be directly aligned and fixed on the alignment member.

10 Claims, 7 Drawing Sheets

HEAD ARRAY UNIT, IMAGE FORMING APPARATUS INCLUDING SAME, AND METHOD FOR MANUFACTURING THE HEAD ARRAY UNIT

CROSS-REFERENCE TO RELATED APPLICATIONS

This patent application is based on and claims priority pursuant to 35 U.S.C. §119 from Japanese Patent Applications No. 2008-001688, filed on Jan. 8, 2008 and No. 2008-313722, filed on Dec. 9, 2008 in the Japan Patent Office, the entire contents of each of which are hereby incorporated herein by reference.

BACKGROUND

1. Technical Field

Exemplary aspects of this disclosure generally relate to a print head array unit and a method of manufacturing the print head array unit, and more particularly, to a print head array unit and a method of manufacturing the print head array unit, and an image forming apparatus that includes the print head array unit.

2. Description of the Background Art

There is known an image forming apparatus, such as a printer, a facsimile machine, a copier, and a multi-functional system including any combination thereof, that employs an ink jet recording device ejecting ink for recording in an image forming operation.

Such an ink jet recording device uses, for example, a recording head that ejects liquid droplets of ink.

In the image forming apparatus of this type, an image forming operation is conducted by the recording head ejecting ink droplets onto a recording medium, typically although not necessarily a sheet of paper. It is to be noted that the image forming operation mentioned herein refers to any operation by which an image is fixed in tangible form, whether by recording, printing, imaging, or some other process or combination of processes.

Such image forming apparatuses are generally classified into two types, a serial-type image forming apparatus and a line-type image forming apparatus.

The serial-type image forming apparatus performs the image forming operation by moving the recording head in a main scan direction while ejecting ink droplets onto a sheet of a recording medium.

By contrast, the line-type image forming apparatus uses a line-type recording head that performs the image forming operation by ejecting the ink droplets without moving the recording head, that is, by keeping the recording head stationary while moving the sheet of the recording medium. Both types have advantages and disadvantages.

In order to form a full-line head including a nozzle array, a length of which is similar or equal to a width of the recording sheet or a so-called long head having the nozzle array, the length of which is similar or equal to half the sheet width direction, there is known a technique in which a number of short heads are arranged in the sheet width direction.

For example, JP-2007-136254-A discloses a head unit in which a liquid droplet discharge head is secured to a head member retainer which is then adjustably mounted to a head holding plate.

Japanese Patent Number 3552522 discloses a method and a device for bonding and assembling of component using a holding member and an adhesive.

According to WO-04-022344, a plurality of ink jet heads is mounted to a position adjustment plate including reference holes, and then the position adjustment plate is mounted and fixed to a common mounting plate member including reference pins by fitting the reference holes of the position adjustment plate to the reference pins of the common plate member.

According to JP-2001-162892-A, a plurality of heads is arranged on a single sub-carriage so as to form a long head. A head portion image acquisition mechanism, a head portion image acquisition mechanism, and a sub-carriage moving mechanism are provided so as to detect the target positions for the heads in order to accurately arrange the plurality of the heads.

It is difficult to form the full-line head using a single head due to fabrication yield and the like. Therefore, in general, instead of using a long single head, a plurality of heads is arranged in a line to form the full-line head. This is a so-called "head array unit".

In such a head array unit, a plurality of heads needs to be arranged accurately relative to a mounting member on which the plurality of heads is mounted and fixed.

However, as described in JP-2001-162892-A, when the plurality of heads is arranged on the single sub-carriage by optically detecting the target positions and then adjusting the position of the heads so as to form the long head, a larger assembly facility is needed, complicating accurate positioning of the plurality of the heads.

Furthermore, as described in WO-04-022344, when the plurality of the ink jet heads is mounted and fixed to the position adjustment plate including the reference holes and then the position adjustment plate is mounted and fixed to the common mounting plate member including the reference pins by fitting the reference holes to the reference pins of the common plate member, a number of reference pins need to be accurately provided to the common mounting plate member, thereby complicating the structure of the common mounting plate member and increasing the cost of the heads.

BRIEF SUMMARY

In an aspect of this disclosure, there is provided a head array unit in which a plurality of head members is easily aligned on an alignment member with a simple structure and a method for manufacturing the head array unit, and an image forming apparatus including the head array unit.

According to another aspect, the head array unit includes a head unit. The head unit includes a head member, a head member retainer, and an alignment member. The head member includes a plurality of nozzles and is configured to eject liquid droplets. The head member retainer, on which the head member is disposed and fixed thereto, includes a reference hole for aligning the head unit relative to an alignment member. The alignment member includes an opening formed at a location associated with the reference hole of the head member retainer and is configured to align and fix the head unit thereto. The opening of the alignment member is substantially larger than that of the reference hole.

According to another aspect, a head array unit includes a head member and an alignment member. The head member includes a plurality of nozzles and a reference hole for aligning and fixing the head member on the alignment member and is configured to eject liquid droplets. The alignment member includes an opening at a location associated with the reference hole. The opening in the alignment member has a diameter larger than a diameter of the reference hole in the head member.

In another aspect of this disclosure, there is provided a method for manufacturing a head array unit involves positioning and fixing a head member that ejects liquid droplets, relative to a head member retainer; inserting an alignment pin of a jig through an opening provided to a alignment member that aligns and fixes the head unit thereto, such that the alignment pin projects substantially above the surface of the alignment member; fitting a reference hole provided to the head member retainer of the head unit with the alignment pin of the jig; fixing the head unit to the alignment member; and removing the jig from the alignment member.

The aforementioned and other aspects, features and advantages would be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
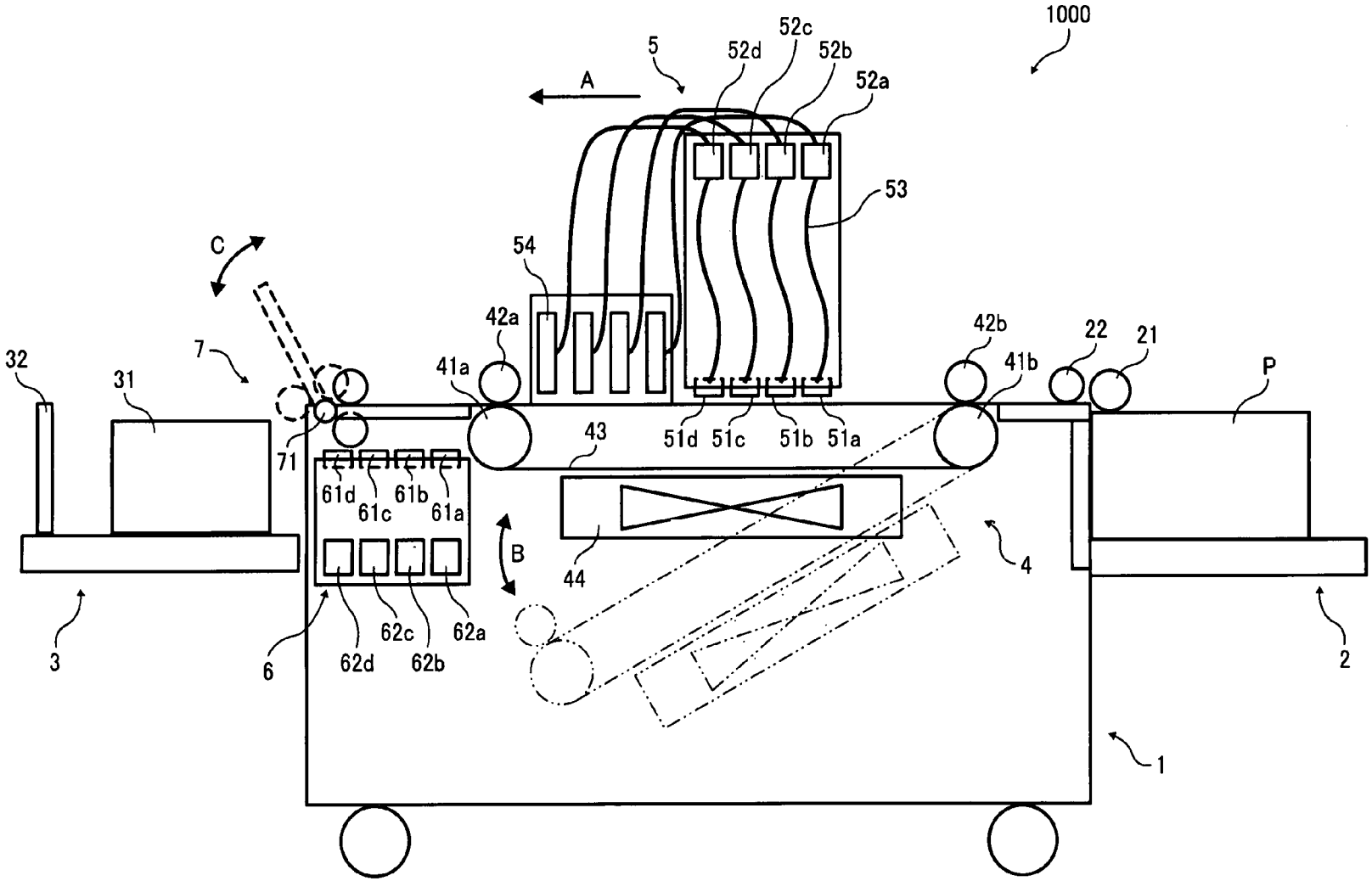
FIG. 1 is a schematic diagram illustrating an example of an image forming apparatus according to an illustrative embodiment of the present invention.

Illustrative embodiments of the present invention are now described below with reference to the accompanying drawings.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity of drawings and descriptions, the same reference numerals are given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included.

Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus, according to an illustrative embodiment of the present invention is described.

Figure 2:
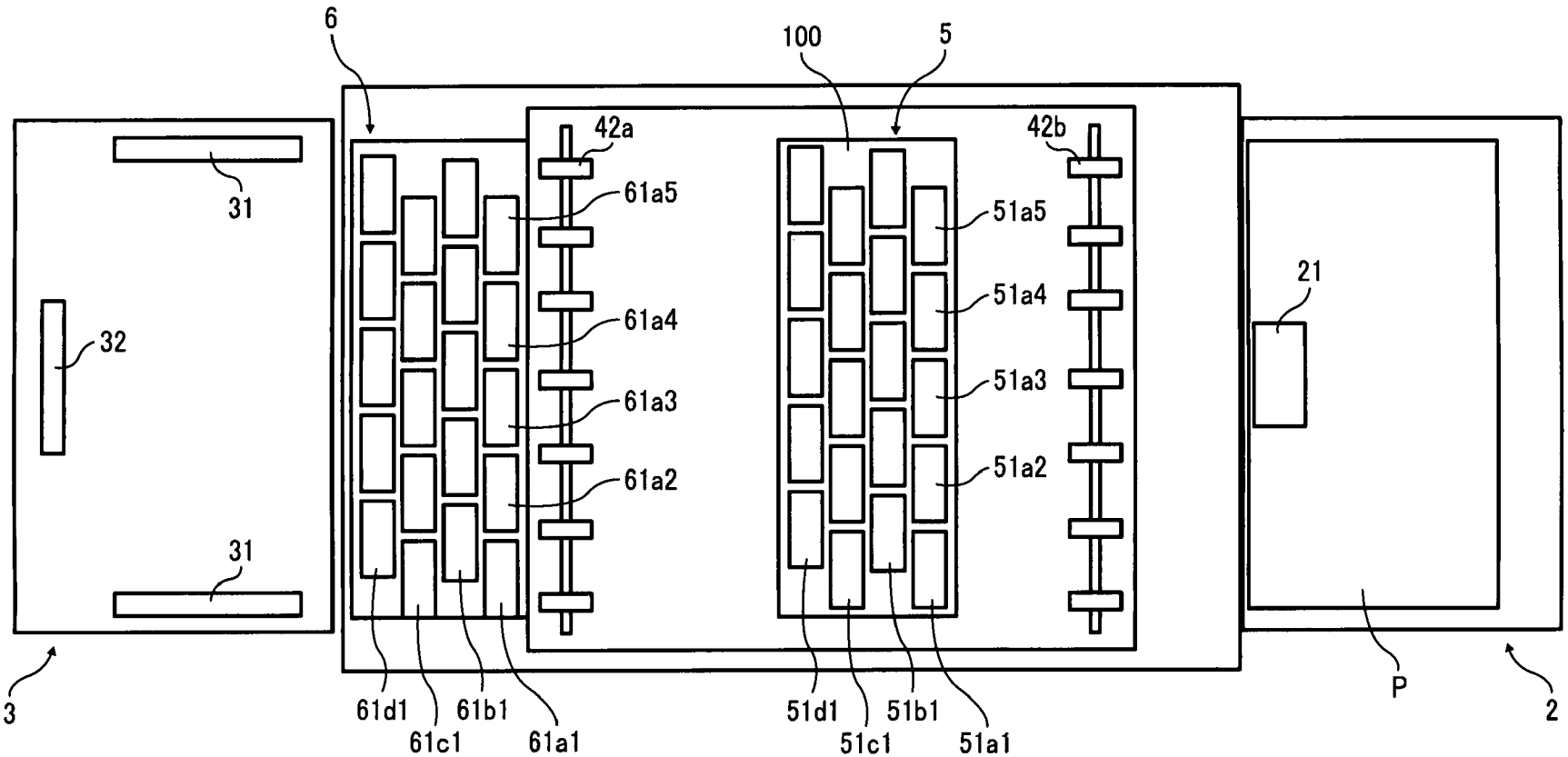
FIG. 2 is a conceptual plan view of the image forming apparatus of FIG. 1 according to an illustrative embodiment of the present invention.

FIG. 1 is a schematic diagram illustrating an overview of the image forming apparatus according to an illustrative embodiment of the present invention. FIG. 2 illustrates a plan view of the image forming apparatus of FIG. 1.

It is to be noted that the image forming apparatus herein refers to an apparatus that performs image forming operation by applying ink to a medium including, but not limited to, paper, a thread, fiber, leather, metal, plastic, wood, ceramic, and the like.

Image formation also includes, in addition to recording, printing and imaging, forming an image including letters, symbols, and patterns on the above-described recording medium. The image forming operation herein also simply refers to applying ink droplets onto the medium.

It is to be noted that the ink is not limited to what is called "ink". The word "ink" is herein used as a collective term that refers to a so-called recording liquid, fixing liquid, and a liquid, that are utilized to form an image.

The sheet-type recording medium includes, but is not limited to, paper, an OHP sheet, and a cloth, onto which the ink is applied.

The image forming apparatus according to the illustrative embodiment is a line-type image forming apparatus. The image forming apparatus 1000 includes at least a main body 1, a sheet feed tray 2, a discharge tray 3, a sheet transport unit 4, a head array unit 5, and a cleaning unit 6.

A plurality of recording sheets P are stacked in the sheet feed tray 2 that feeds the recording sheets P. The recording sheet P after printing operation is placed onto the discharge tray 3.

The sheet transport unit 4 transports the recording sheet from the sheet feed tray 2 to the discharge tray 3. The head array unit 5 ejects droplets of ink onto the recording sheet P that is transported by the transport unit 4 so as to perform printing.

After printing operation or at a predetermined timing, the cleaning unit 6 cleans each head of the head array unit 5 so as to recover the state of the head array unit 5 in preparation for a subsequent operation.

The main body 1 of the image forming apparatus 1000 is formed with front, back, and side panels, and stays, not illustrated.

The recording sheets P stacked on the sheet feed tray 2 are fed to the sheet transport unit 4 one sheet at a time by using a separation roller 21 and a sheet feed roller 22.

The sheet transport unit 4 includes a drive roller 41*a* and a driven roller 41*b* for transport of the sheet, and a sheet transport belt 43 that is wound around the drive roller 41*a* and the driven roller 41*b*.

A plurality of holes, not illustrated, is formed on the surface of the sheet transport belt 43. Substantially below the sheet transport belt 43, a sheet suction fan 44 that suctions the recording sheet P is disposed.

Substantially above the drive roller 41*a* and the driven roller 41*b*, transport guide rollers 42*a* and 42*b* are supported by guides, not illustrated, and contact the sheet transport belt 43 by self-weight.

The drive roller 41*a* is rotated by a motor, not illustrated, causing the sheet transport belt 43 to move. Subsequently, the recording sheet P is attracted onto the sheet transport belt 43 by the sheet suction fan 44. As the sheet transport belt 43 travels, the recording sheet P is transported.

It is to be noted that the driven roller 41*b*, and the transport guide rollers 42*a* and 42*b* are rotated in association with the sheet transport belt 43.

As illustrated in FIG. 1, the head array unit 5 that ejects liquid droplets P is disposed substantially above the sheet transport unit 4, and movable in a direction of arrow A so as to form an image on the recording sheet.

The head array unit 5 slidingly travels to a position substantially above the cleaning unit 6 at the time of recovery, that is, when cleaning is to be performed.

Referring now to FIG. 2, there is provided a plan view for explaining the head array unit 5 of the image forming apparatus 1000, according to the illustrative embodiment.

In FIG. 2, the head array unit 5 includes a plurality of head units 51 (five in this case) in a single row in a width direction of the recording sheet P, arranged across substantially an entire width of the recording sheet P on an alignment member 100 serving as a holding member and fixed thereto. Each head unit 51 is configured to eject ink droplets.

As illustrated in FIG. 2, from substantially upstream in the sheet transport direction, a first row (hereinafter referred to as Line-a), a second row (hereinafter referred to as Line-b), a third row (hereinafter referred to as Line-c), and a fourth row (hereinafter referred to as Line-d) are arranged.

According to the illustrative embodiment, there are five head units 51 in a single row, for example. In Line-a, head units 51*a*1, 51*a*2, 51*a*3, 51*a*4, and 51*a*5 are arranged. In Line-b, head units 51*b*1, 51*b*2, 51*b*3, 51*b*4, and 51*b*5 are arranged. In Line-c, head units 51*c*1, 51*c*2, 51*c*3, 51*c*4, and 51*c*5 are arranged. In Line-d, head units 51*d*1, 51*d*2, 51*d*3, 51*d*4, and 51*d*5 are arranged.

It is to be noted that, when the head units 51 in each row are referred to collectively, for example, when the head units 51*a*1, 51*a*2, 51*a*3, 51*a*4, and 51*a*5 in the first row, that is, in Line-a, are referred to collectively and no differentiation therebetween is necessary, the head units 51*a*1, 51*a*2, 51*a*3, 51*a*4, and 51*a*5 in Line a are simply referred to as "head unit array 51*a*", unless otherwise specified.

In FIG. 2, each of the head units 51*a* through 51*d* in Line-a through Line-d is alternately arranged. Each of the head units 51 is provided with a plurality of nozzle arrays (in this case two nozzle arrays), each of which is provided with a plurality of nozzles.

One of the nozzle arrays of 51*a* of Line-a and one of the nozzle arrays of 51*b* of Line-b eject ink droplets of yellow. The other nozzle array of 51*a* and the other nozzle array of 51*b* eject ink droplets of magenta. One of the nozzle arrays of 51*c* of Line-c and one of the nozzle arrays of 51*d* of Line-d eject ink droplets of cyan. The other nozzle array of 51*c* and the other nozzle array of 51*d* eject ink droplets of black. With this structure, an image for one line can be formed.

The configuration of the head unit 51 is not limited to the configuration described above. Alternatively, two head array units 5 can be provided. Both nozzle arrays of each of the head units 51 may eject ink droplets of a single color, thereby enhancing image resolution, for example, obtaining twice the resolution obtained by the configuration described above.

Referring back to FIG. 1, substantially above each of the head units 51, the head array unit 5 includes, distributors 52*a*, 52*b*, 52*c*, and 52*d*. Each of the distributors 52*a*, 52*b*, 52*c*, and 52*d* is configured to distribute ink of a predetermined color to the head units 51.

It is to be noted that the distributors 52*a*, 52*b*, 52*c*, and 52*d* are hereinafter simply referred to collectively as the distributors 52 unless otherwise specified.

The head units 51 and the distributors 52 are connected by supply tubes 53. Substantially upstream from the distributors 52, sub-tanks 54 are disposed. The sub-tanks 54 are configured to supply appropriate ink to the heads of the head units 51.

Substantially upstream from the sub-tanks 54, main tanks, not illustrated, are disposed. The main tanks are configured to supply ink through conduits.

In FIG. 1, substantially downstream from the sheet transport unit 4, a sheet transport guide portion 7 that discharges the recording sheet P onto the discharge tray 3 is provided. The sheet transport guide portion 7 guides the recording sheet P onto the discharge tray 3.

The discharge tray 3 includes a side fence 31 and an end fence 32. The side fence 31 is configured to regulate the recording sheet P in the width direction thereof. The end fence 32 is configured to regulate the leading edge of the recording sheet P.

Referring back to FIG. 2, the cleaning unit 6 serving as a cleaning/recovery device includes a plurality of cleaning devices 61 (five in this case) in a single row associated with each of the head units 51 in Line-a through Line-d.

In particular, in the first row of the cleaning unit 6, cleaning devices 61*a*1, 61*a*2, 61*a*3, 61*a*4, and 61*a*5 are disposed. In the second row, the cleaning devices 61*b*1, 61*b*2, 61*b*3, 61*b*4, and 61*b*5 are disposed. In the third row, the cleaning devices 61*c*1, 61*c*2, 61*c*3, 61*c*4, and 61*c*5 are disposed. In the fourth row, the cleaning devices 61*c*1, 61*d*2, 61*d*3, 61*d*4, and 61*d*5 are disposed. The cleaning devices 61 are alternately arranged in the cleaning unit 6.

It is to be noted that, when the cleaning devices 61 in each row are referred to collectively, for example, when the cleaning devices 61*a*1, 61*a*2, 61*a*3, 61*a*4, and 61*a*5 in the first row are referred to collectively and no differentiation therebetween is necessary, the cleaning devices 61*a*1, 61*a*2, 61*a*3, 61*a*4, and 61*a*5 are simply referred to as "cleaning devices 61*a*", unless otherwise specified.

Substantially below each of the cleaning devices 61, suction pumps 62 (62*a*, 62*b*, 62*c*, 62*d*) are provided to suction ink from the respective heads of the head units 51.

With this configuration, when the nozzle surfaces of the heads of the head units 51 that eject ink droplets are capped by the cleaning devices 61 after printing is finished, the ink can be suctioned from the heads of the head units 51 so as to clean the heads of the head unit 51.

When the ink adhering to the nozzle surfaces of the heads of the head units 51 is removed by the cleaning devices 61 after printing is halted, the entire sheet transport unit 4 turns about the driven roller 41*b* serving as a fulcrum in a direction of arrow B. Accordingly, space between the head array unit 5 and the sheet transport unit 4 increases, thereby securing space that allows the head array unit 5 to travel.

At this time, the sheet transport guide portion 7 disposed substantially above the cleaning unit 6 also rotatably moves upward about a fulcrum 71 in a direction of arrow C in FIG. 1, thereby exposing the upper portion of the cleaning unit 6.

After the sheet transport unit 4 and the sheet transport guide portion 7 are released or rotated so as to provide space in which the head array unit 5 can travel, the head array unit 5 travels in the sheet transport direction, that is, the direction of arrow A in FIG. 1, and then the head array 5 stops substantially above the cleaning unit 6. Subsequently, the cleaning devices 61 rise so as to initiate a cleaning operation (recovery operation) of the heads of each of the head units 51.

Next, with reference to FIGS. 3 through 8, a description will be provided of the head array unit 5 according to one illustrative embodiment of the present invention.

Figure 3:
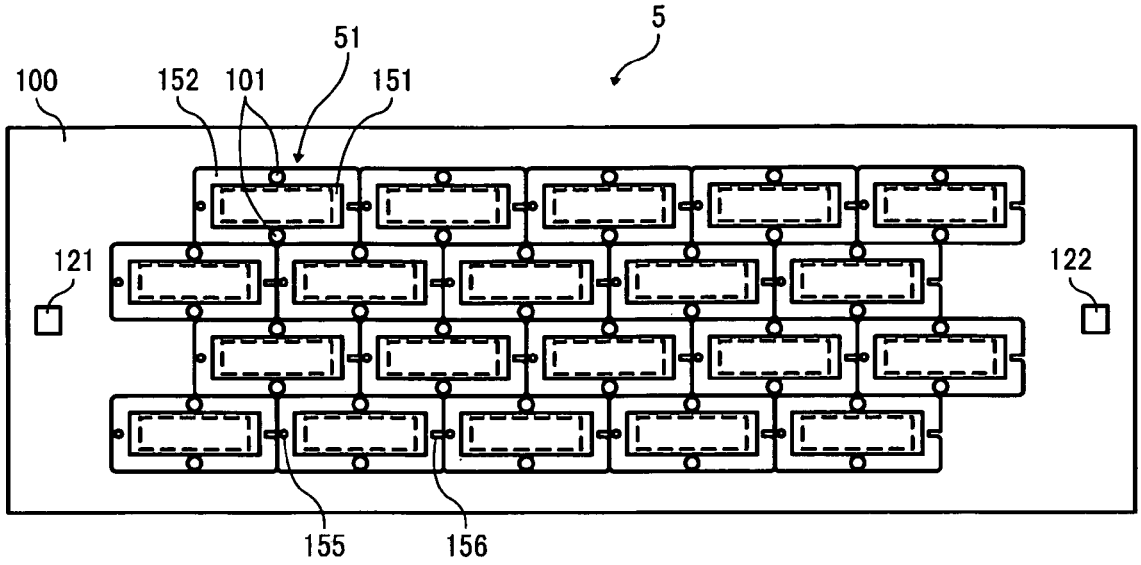
FIG. 3 is a conceptual plan view of an example of a head array unit according to an illustrative embodiment of the present invention.
Figure 4:
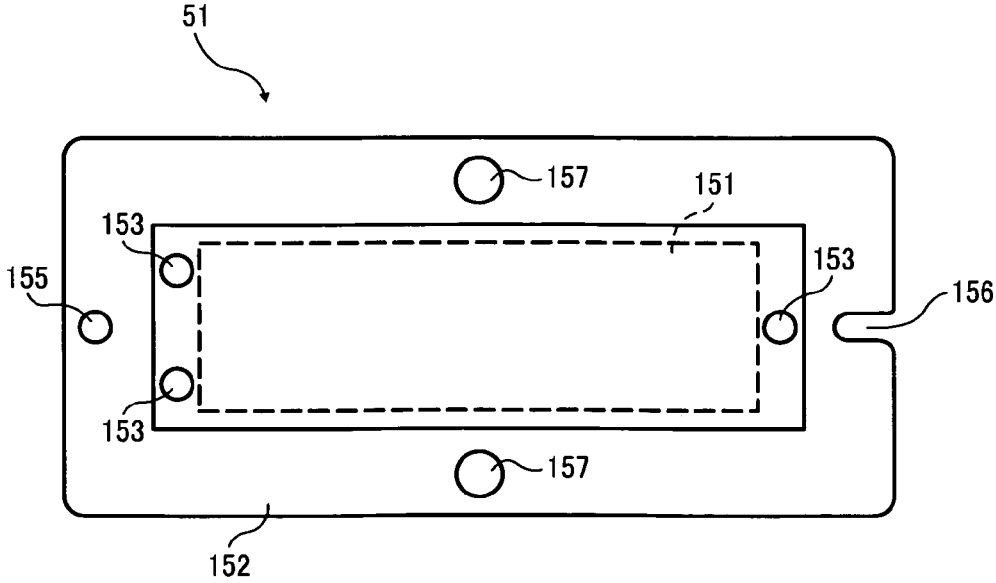
FIG. 4 is a conceptual plan view of a head unit of the head array unit of FIG. 3 according to an illustrative embodiment of the present invention.
Figure 5:
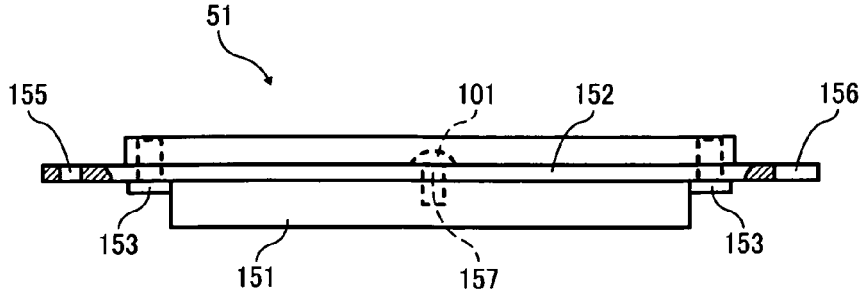
FIG. 5 is a conceptual front view of the head unit of FIG. 4 according to an illustrative embodiment of the present invention.
Figure 6:
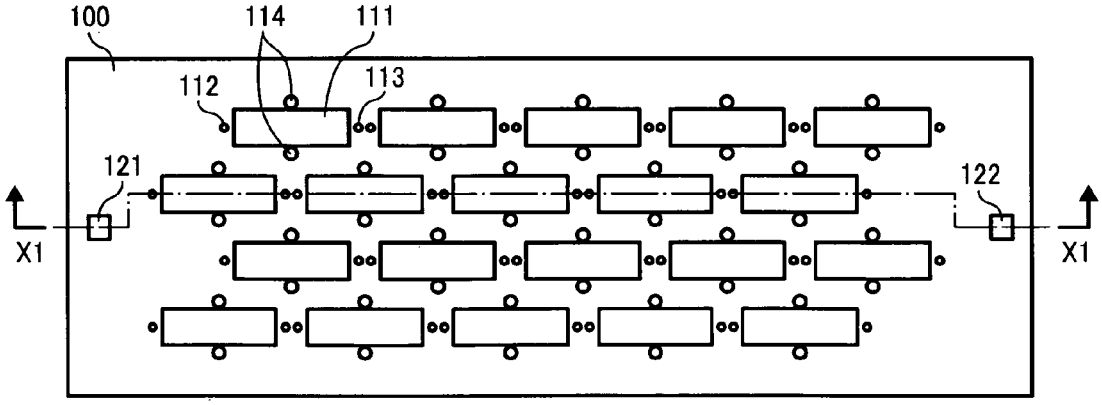
FIG. 6 is a conceptual plan view of an alignment member of the head array unit according to an illustrative embodiment of the present invention.
Figure 7:
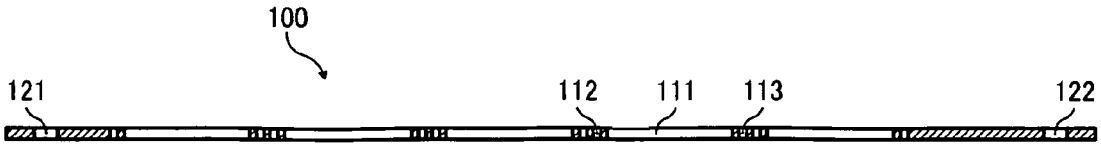
FIG. 7 is a conceptual cross-sectional view taken along a line X1-X1 shown in FIG. 6 according to an illustrative embodiment of the present invention.
Figure 8:
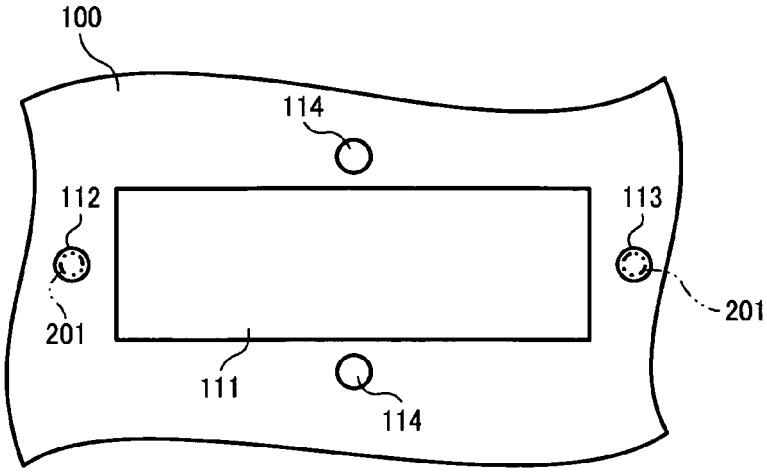
FIG. 8 is a partially enlarged conceptual plan view of the alignment member according to an illustrative embodiment of the present invention.

FIG. 3 is a plan view of the head array unit 5. FIG. 4 is a plan view of one of the head units 51. FIG. 5 is a front view of the head unit 51 of FIG. 4. FIG. 6 is a plan view of the alignment member 100. FIG. 7 is a cross-sectional view of the alignment member 100 taken along line X1-X1. FIG. 8 is a partially enlarged plan view of the alignment member 100.

As illustrated in FIG. 3, the head array unit 5 includes a plurality of the head units 51, each of which includes a head member 151 having a plurality of nozzles that eject ink droplets and which is positioned on and fixed to a head member retainer 152, also called an intermediate member or an attachment member, of the head unit 51.

The plurality of the head units 51, in this case, five head units 51, are arranged in a single row on the alignment member 100 in the sheet width direction. Each of the head units 51 is fixed onto the alignment member 100 by a fastening member 101.

It is to be noted that although five head units 51 are arranged in a single row on the alignment member 100 according to the illustrative embodiment, the number of head units is hot limited to five.

As illustrated in FIGS. 4 and 5, in each head unit 51, the head member 151 is accurately positioned relative to the head member retainer 152 using an optical positioning method or the like. The head member 151 is fastened to the head member retainer 152 by fastening members 153 at three locations, for example.

The head member retainer 152 includes a main reference hole 155 and a sub-reference notch 156. When the head unit 51 is arranged on the alignment member 100, the main reference hole 155 and the sub-reference notch 156 are used to determine the position of the head unit 51 relative to the alignment member 100.

The head member retainer 152 includes also two through-holes 157, through which the fastening members 101 that fasten the head unit 51 onto the alignment member 100 are inserted.

As illustrated in FIG. 4, according to the illustrative embodiment, the sub-reference notch 156 is a substantially C-shaped incision. It is to be noted, however, that alternatively, the sub-reference notch 156 may be an elongated slot.

Next, with reference to FIGS. 6 through 8, a description will be provided of the alignment member 100.

As illustrated in FIGS. 6 through 8, the alignment member 100 includes a plurality of openings 111, in numbers equal to the number of head units 51 that are provided. The heads 151 of the head units 51 are fitted into the openings 111.

A hole 112 is formed at one side of the openings 111 in the direction of the row in which the head units 51 are disposed, that is, in a long direction thereof. The hole 112 is formed relatively larger than the main reference hole 155 for positioning of the head unit 51, and is associated with the main reference hole 155.

A hole 113 is formed at the other side of each of the openings 111, and associated with the sub-reference notch 156 for positioning of the head unit 51.

At both sides of each of the openings 111 in a direction perpendicular to the head unit array, that is, the direction equivalent to the sheet transport direction, in other words in a short direction of the openings 111, screw holes 114 are provided, through which the fastening members 101 are inserted.

Further, at both ends of the alignment member 100 in the arrangement direction of the head unit, an array reference hole 121 and an array sub-reference hole 122 are provided, respectively, so as to position a later-described jig 200. Each of the openings 112 is provided with reference to the array main reference hole 121.

Since the openings 112 are formed on the alignment member 100 such that the openings 112 are associated with the main reference holes 155 that are used to position the head units 51 relative to the alignment member 100, the head units 51 are properly positioned and fixed to the alignment member 100 by fitting alignment pins provided to the later-described jig 200 through the openings 112 of the alignment member 100 and the main reference holes 155 of the head unit 51.

With this configuration, there is no need to provide the alignment pins to the alignment member 100, thereby simplifying the structure and allowing accurate positioning of the plurality of heads 151 relative to the alignment member 100 with a simple configuration.

Accordingly, each head can be accurately positioned relative to the respective head unit in the head array unit, thereby making it possible to achieve better imaging quality with relatively high speed image formation.

Figure 9:
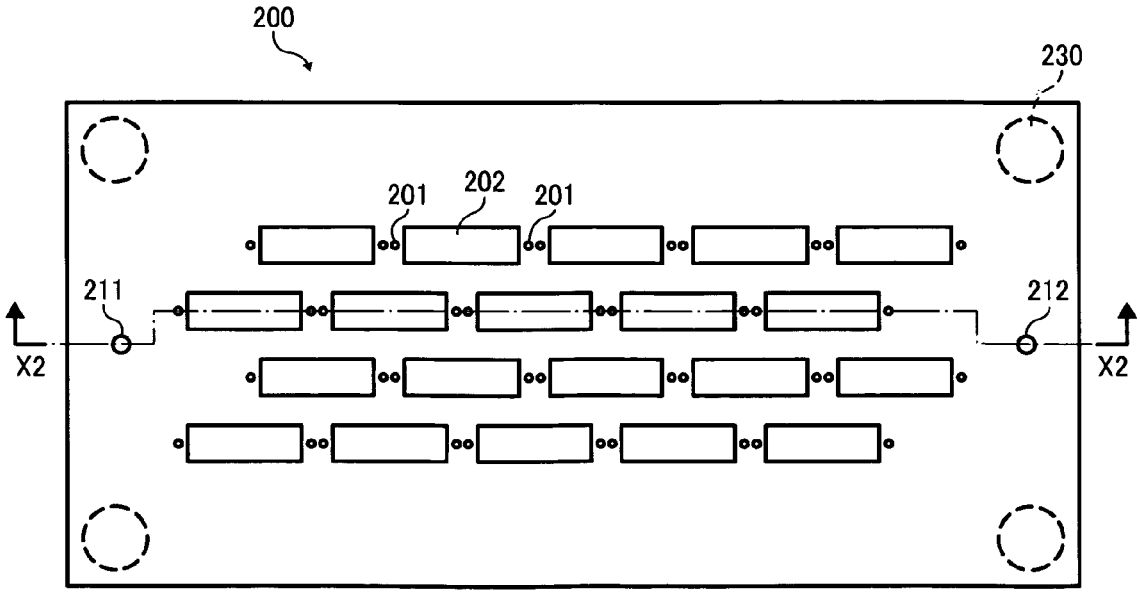
FIG. 9 is a conceptual plan view of a jig used for manufacturing the head array unit according to an illustrative embodiment of the present invention.
Figure 10:
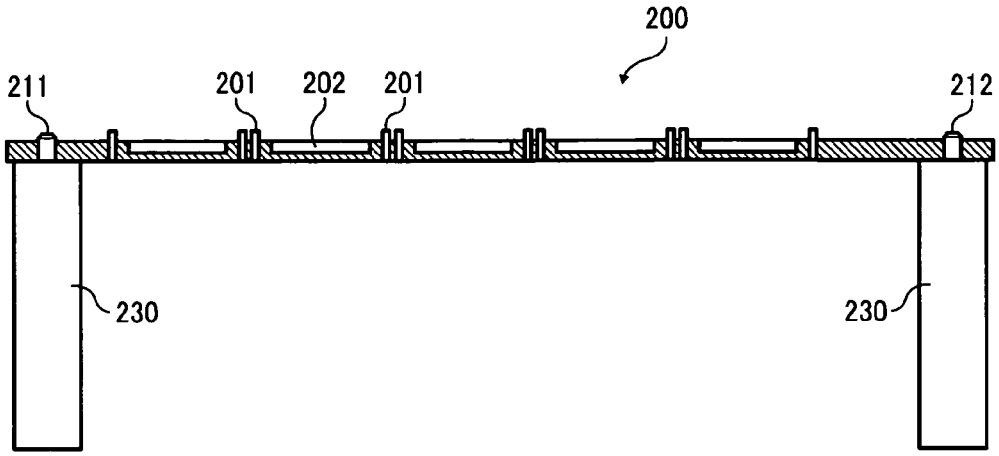
FIG. 10 is a conceptual cross-sectional view taken along a line X2-X2 shown in FIG. 9 according to an illustrative embodiment of the present invention.

With reference to FIGS. 9 and 10, a description will now be provided of the jig 200 that is used when manufacturing the head array unit 5.

FIG. 9 is a plan view conceptually illustrating the jig 200. FIG. 10 is a cross-sectional view of the jig 200 taken along line X2-X2 of FIG. 9.

The jig 200 includes pairs of alignment pins 201 in numbers equal to the number of the head units 51. The pair of the alignment pins 201 is fitted through the main reference holes 155 and the sub-reference notch 156 formed in the head member retainer 152 of the head unit 51.

The length of the alignment pins 201 is configured to be long enough to penetrate through the openings 112 and 113 of the alignment member 100 and fit into the main reference hole 155 and the sub-reference notch 156 of the head unit 51.

It is to be noted that a recessed portion 202 is formed between the alignment pins 201 that serves as a clearance for the head member 151 when positioning the head member 151.

The jig 200 includes also jig main alignment pin 211 and jig sub-alignment pin 212. The jig main alignment pin 211 is fitted into the array main reference hole 121. The jig sub-alignment pin 212 is fitted into the array sub-reference hole 122. With this configuration, the alignment member 100 and the jig 200 can be properly aligned.

It is to be noted that the jig 200 is provided with legs 230, as shown in FIG. 10.

With reference to FIGS. 11 through 14, a description will be now provided of a manufacturing process for the head array unit 5 using the jig 200.

Figure 11:
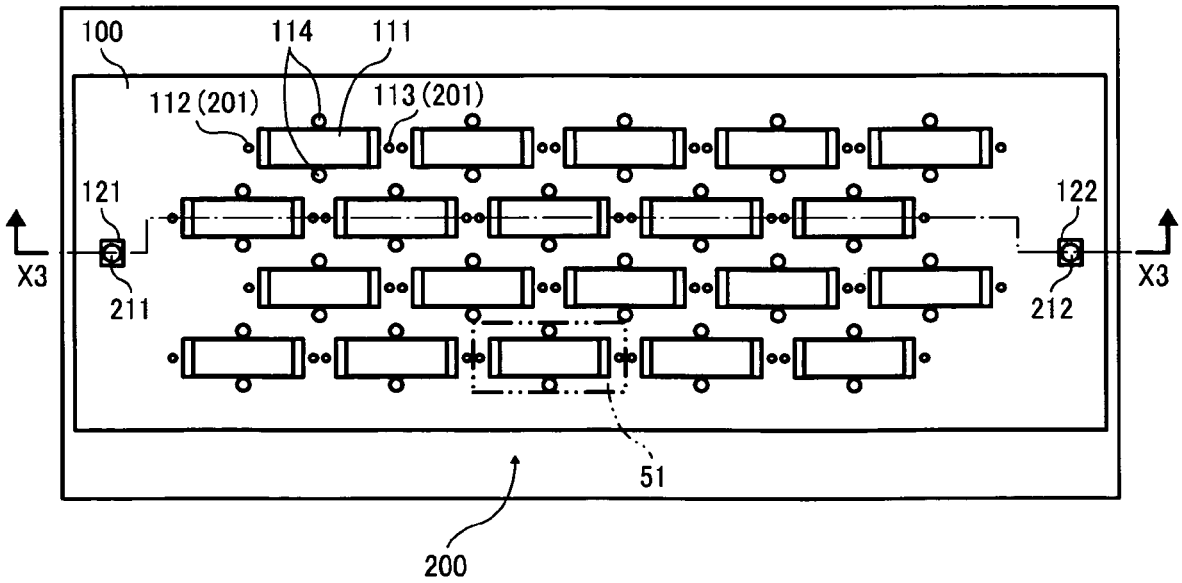
FIG. 11 is a conceptual plan view of the alignment member mounted on the jig of FIG. 9 according to an illustrative embodiment of the present invention.
Figure 12:
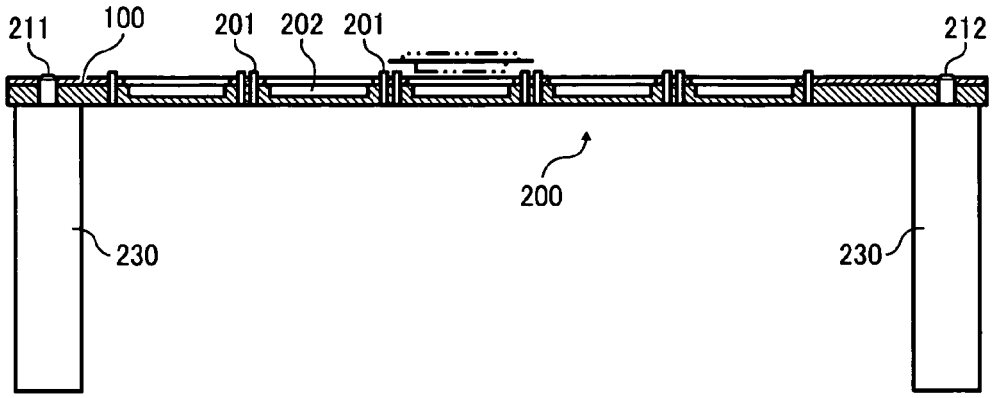
FIG. 12 is conceptual cross-sectional view taken along a line X3-X3 shown in FIG. 11 according to an illustrative embodiment of the present invention.
Figure 13:
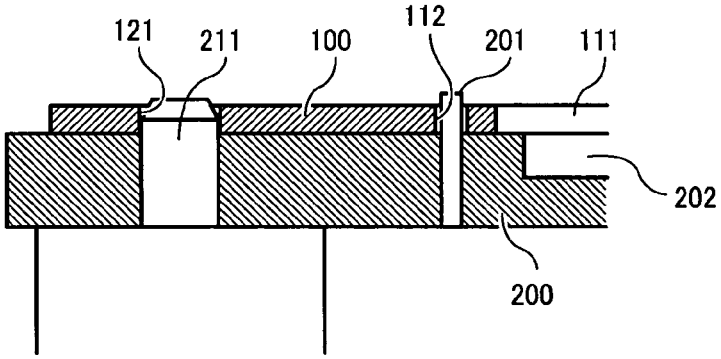
FIG. 13 is a partially enlarged conceptual cross-sectional view of an engaging portion of the jig and the alignment member according to an illustrative embodiment of the present invention.
Figure 14:
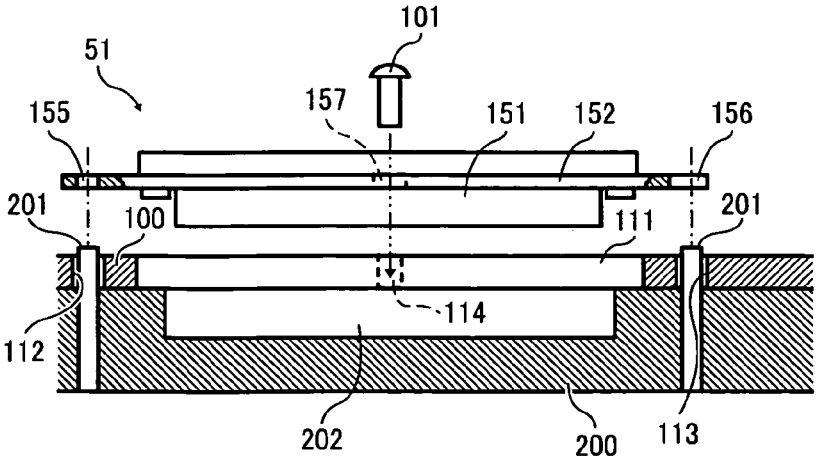
FIG. 14 is a partially enlarged conceptual cross-sectional view of mounting of the head unit according to an illustrative embodiment of the present invention.

FIG. 11 is a conceptual plan view of mounting of one of head units 51 when the alignment member 100 is disposed on the jig 200. FIG. 12 is a cross-sectional view of the jig 200 taken along line X3-X3 of FIG. 11. FIG. 13 is a partially enlarged cross-sectional view of the jig 200 fitted together with the alignment member 100. FIG. 14 is a partially enlarged cross-sectional view of mounting of the head unit 51.

First, as previously explained with reference to FIGS. 4 and 5, the head member 151 that ejects ink droplets is accurately positioned relative to the head member retainer 152 using the optical positioning method or the like. The head member 151 is fastened to the head member retainer 152 by the fastening members 153 at for example three locations, to form the head unit 51.

Subsequently, as illustrated in FIGS. 11 and 12, the alignment member 100 is disposed on the jig 200. At this time, as illustrated in FIG. 13, the jig main alignment pin 211 of the jig 200 is fitted into the array main reference hole 121 of the alignment member 100, and the jig sub-alignment pin 212 of the jig 200 is fitted into the array sub-reference hole 122, thereby positioning the alignment member 100 relative to the jig 200.

Accordingly, the alignment pins 201 of the jig 200 are properly positioned relative to the openings 112 and the openings 113 of the alignment member 100.

As a result, as illustrated in FIG. 14, the alignment pins 201 are reliably inserted into the openings 112 and 113. A portion of the alignment pins 201 projects substantially above the surface of the alignment member 100.

It is to be noted that, as illustrated in FIG. 13, the internal diameter of the hole 112 is substantially greater than the external diameter of the alignment pin 201 so as to provide a slight allowance therebetween to facilitate insertion. With this configuration, even if the center of the hole 112 and the center of the alignment pin 201 are misaligned, the alignment pin 201 can still be inserted into the hole 112, thereby allowing the alignment member 100 to be mounted on the jig 200.

Subsequently, the main reference hole 155 and the sub-reference notch 156 of the head unit 51 are fitted with the alignment pins 201 of the jig 200 that project from the surface of the alignment member 100.

The fastening member 101 is fitted into the screw hole 114 of the alignment member 100 via the through hole 157 of the head unit 51, thereby fastening the head unit 51 to the alignment member 100.

The same process is performed for each head unit 51 so as to align and fix the head units 51 onto the alignment member 100. After that, when the alignment member 100 is removed from the jig 200, the head array unit 5 equipped with the alignment member 100 on which the predetermined number of the head units 51 are disposed is obtained.

According to the illustrative embodiment, the manufacturing method of the head array unit 5 includes the steps of: Positioning and securing the heads 151 on the head member retainers 152 so as to assemble the plurality of the head units 51; securing the head units 51 on the alignment member 100 including the openings 112 through which the alignment pins 201 are inserted, such that a portion of the alignment pins 201 projects substantially above the alignment member 100; fitting the alignment pins 201 of the jig 200 into the reference holes 155 formed on the head member retainers 152 of the plurality of the head units 51; fixing the plurality of the head units 51 on the alignment member 100; and removing the jig 200 from the alignment member 100.

With this configuration, the jig 200 can be removed after the alignment pins 201 of the jig 200 are fitted into the reference holes 155 of the head unit 51. Therefore, the alignment member 100 does not have to include the alignment pins, thereby simplifying the structure and allowing accurate positioning of the plurality of heads 151 relative to the alignment member 100.

It is to be noted that the relative positions of the plurality of the head units 51 are determined based on the alignment pins 201 of the jig 200. Thus, the inner diameter of the main reference holes 155 in the head member retainer 152 needs to be substantially the same as the outer diameter of the alignment pins 201. Accurately forming the jig 200 allows accurate alignment of the head units 51.

The openings 112 of the alignment member 100 are provided so as to facilitate alignment of the head units 51 relative to the alignment member 100. When the openings 112 are substantially greater than the main reference holes 155, it is not necessary to form the openings 112 as accurately as forming the alignment pins 201. Consequently, productivity of the alignment member 100 can be improved.

The foregoing description pertains to a head array unit including a plurality of head units aligned and fixed on an alignment member. Each of the head unit is equipped with a head member and a head member retainer on which the head member is fixed. The head member retainer including the head member is fixed on the alignment member.

Alternatively, the head array unit includes the head member and the alignment member on which the head member can be directly aligned and fixed.

According to this embodiment, the head member includes a reference hole for aligning the head member relative to the alignment member, and is configured to eject liquid droplets. The alignment member includes an opening at a location associated with the reference hole in the head member.

An alignment pin of a jig can be inserted through the opening in the alignment member and into and through the reference hole in the head member. The opening in the alignment member has a diameter larger than a diameter of the reference hole in the head member.

With this configuration, there is no need to provide the alignment pins to the alignment member, thereby simplifying the structure and allowing accurate positioning of the plurality of heads relative to the alignment member with a simple configuration.

It is to be noted that elements and/or features of different illustrative embodiments may be combined with each other and/or substituted for each other within the scope of this disclosure and appended claims.

The number of constituent elements, locations, shapes and so forth of the constituent elements are not limited to any of the structure for performing the methodology illustrated in the drawings.

Still further, any one of the above-described and other illustrative features of the present invention may be embodied in the form of an apparatus, method, or system.

Illustrative embodiments being thus described, it will be obvious that the same may be varied in many ways. Such illustrative variations are not to be regarded as a departure from the scope of the present invention, and all such modifications as would be obvious to one skilled in the art are intended to be included within the scope of the following claims.

What is claimed is:

1. A head array unit, comprising:

a head unit including a head member including a plurality of nozzles, configured to eject liquid droplets; and a head member retainer on which the head member is disposed and fixed thereto, the head member including a first reference hole and a second reference hole for aligning the head unit relative to an alignment member; and the alignment member including first and second openings at respective locations associated with the first reference hole and the second reference hole, respectively, at least one of the first and second openings in the alignment member having a diameter larger than a diameter of the corresponding reference hole in the head member retainer, wherein a distance between the first and second openings in the alignment member is substantially same as a distance between the first and second reference holes in the head member retainer, and wherein the second reference hole is a notch in a form of an elongated slot on an edge of the head member retainer.

2. The head array unit according to claim 1, wherein the head member retainer further includes a second hole different from the reference hole, through which a fastening member is inserted so as to fix the head member retainer to the alignment member.

3. The head array unit according to claim 1, wherein the alignment member further includes a plurality of the openings so as to align a plurality of the head units, and the reference holes in the plurality of the head member retainers are provided associated with the openings in the alignment member.

4. The head array unit according to claim 1, wherein an alignment pin of a jig is inserted through the opening in the alignment member and into and through the reference hole in the head member retainer.

5. The head array unit according to claim 1, wherein the first reference hole in the head member retainer and the first opening in the alignment member are aligned such that a first straight path in an axial direction of the first reference hole and the first opening penetrates the first reference hole and the first opening, and the second reference hole in the head member retainer and the second opening in the alignment member are aligned such that a second straight path in an axial direction of the second reference hole and the second opening penetrates the second reference hole and the second opening.

6. An image forming apparatus including the head array unit of claim 1.

7. A head array unit, comprising:

a head unit including a head member including a plurality of nozzles, configured to eject liquid droplets; and a head member retainer on which the head member is disposed and fixed thereto, the head member including a first reference hole and a second reference hole for aligning the head unit relative to an alignment member; and the alignment member including first and second openings at respective locations associated with the first reference hole and the second reference hole, respectively, at least one of the first and second openings in the alignment member having a diameter larger than a diameter of the corresponding reference hole in the head member retainer, wherein a distance between the first and second openings in the alignment member is substantially same as a distance between the first and second reference holes in the head member retainer, and wherein the second reference hole is a notch in a form of a C-shaped incision on an edge of the head member retainer.

8. An image forming apparatus including the head array unit of claim 7.

9. A head array unit, comprising:

a head unit including a head member including a plurality of nozzles, configured to eject liquid droplets; and a head member retainer on which the head member is disposed and fixed thereto, the head member including a first reference hole and a second reference hole for aligning the head unit relative to an alignment member; and the alignment member including first and second openings at respective locations associated with the first reference hole and the second reference hole, respectively, at least one of the first and second openings in the alignment member having a diameter larger than a diameter of the corresponding reference hole in the head member retainer, wherein a distance between the first and second openings in the alignment member is substantially same as a distance between the first and second reference holes in the head member retainer, wherein an alignment pin of a jig is inserted through the opening in the alignment member and into and through the reference hole in the head member retainer, and wherein a first gap between the alignment pin and the opening in the alignment member is greater than a second gap between the alignment pin and the reference hole in the head member retainer.

10. An image forming apparatus including the head array unit of claim 9.

* * * * *